US005520711A

United States Patent [19]

Helmin

[11] Patent Number: 5,520,711

[45] Date of Patent: May 28, 1996

[54] METHOD OF MAKING A COATED ABRASIVE ARTICLE COMPRISING A GRINDING AID DISPERSED IN A POLYMERIC BLEND BINDER

[75] Inventor: Harvey J. Helmin, Golden Valley, Minn.

[73] Assignee: Minnesota Mining and Manufacturing Company, St. Paul, Minn.

[21] Appl. No.: 441,626

[22] Filed: May 15, 1995

Related U.S. Application Data

[62] Division of Ser. No. 48,849, Apr. 19, 1993, Pat. No. 5,441, 549.

[51] Int. Cl.[6] ..... B24D 18/00; B24B 1/00

[52] U.S. Cl. ..... 51/295; 51/298; 451/28; 451/59

[58] Field of Search ..... 51/293, 295, 298; 427/222; 428/224; 451/28, 59

[56] References Cited

U.S. PATENT DOCUMENTS

| | | | |
|---|---|---|---|
| 2,022,893 | 12/1935 | Martin | 51/299 |
| 2,177,940 | 10/1939 | Klatler et al. | 51/298 |
| 2,384,684 | 9/1945 | Kistler | 51/299 |
| 3,058,819 | 10/1962 | Paulson | 51/295 |
| 3,232,729 | 2/1966 | Holland et al. | 51/298 |
| 3,256,076 | 6/1966 | Duwell et al. | 51/295 |
| 3,541,739 | 11/1970 | Bryon et al. | 51/295 |
| 3,718,447 | 2/1973 | Hibbs, Jr. et al. | 51/298 |
| 3,806,956 | 4/1974 | Supkis et al. | 51/295 |
| 3,925,034 | 12/1975 | Anna et al. | 51/296 |
| 3,963,458 | 6/1976 | Gladstone et al. | 51/295 |
| 3,997,302 | 12/1976 | Supkis | 51/295 |
| 4,111,667 | 9/1978 | Adams | 51/298 |
| 4,253,850 | 3/1981 | Rue et al. | 51/298 |
| 4,500,373 | 2/1985 | Kubota | 156/79 |
| 5,436,063 | 7/1995 | Follett et al. | 428/224 |

FOREIGN PATENT DOCUMENTS

0418738A2 9/1990 European Pat. Off. ..... B24D 3/28

OTHER PUBLICATIONS

Piccotex® LC–55WK, Anionic, Pure Monomer Resin Dispersion, No. 7493–2, published Jun. 1989.
Picco® 6000 Aromatic Hydrocarbon Resins, No. 7173–8, published Oct. 1990.
Picco® 5000 Aromatic Hydrocarbon Resins, No. 7305–4, published Jun. 1990.
Piccolastic® A5 and A75, Medium Softening Point, Pure Monomer Resins, No. 7166–7, published Jan. 1991.
Hercules® Res A–2348 Resin Dispersion, No. DD–201, published Mar. 1992.
Rubber–Urethane Quality Contact Wheels, By Hi–Lite Rubber Products, publication date unknown.
English Abstract of SU 465317 A, 20 Aug. 1975.
English Abstract of JP 4046772 A, 17 Feb. 1992.
English Abstract of JP 3139320, Published Jun. 13, 1991.
English Abstract of JP 59–002227, Published Jul. 1, 1984.

*Primary Examiner*—Deborah Jones
*Attorney, Agent, or Firm*—Gary L. Griswold; Walter N. Kirn; Doreen S. L. Gwin

[57] ABSTRACT

Abrasive articles and methods of making and using same are presented, the abrasive articles having a peripheral surface adapted to contact and abrade a workpiece. The abrasive articles comprise abrasives particles and a grinding aid composition positioned at an effective location in reference to the abrasive particles, the grinding aid composition comprising:

a) a cured grinding aid binder comprising a blend of a thermoplastic resin and a thermoset resin, the thermoplastic resin and thermoset resin being present at an effective weight ratio; and b) an effective amount of a grinding aid dispersed in the grinding aid binder.

17 Claims, No Drawings

METHOD OF MAKING A COATED ABRASIVE ARTICLE COMPRISING A GRINDING AID DISPERSED IN A POLYMERIC BLEND BINDER

This is a division of application No. 08/048,849 filed Apr. 19, 1993, now U.S. Pat. No. 5,441,549.

BACKGROUND OF THE INVENTION

1. Field of the Invention

This invention relates to abrasive articles comprising a grinding aid dispersed in a binder. The binder is comprised of a blend of thermoplastic and thermoset resins.

2. Discussion of the Art

Abrasive articles generally comprise abrasive grains secured within a binder. In a bonded abrasive, the binder serves to bond the abrasive grains together such that they form a shaped mass. Typically, this shaped mass is in the form of a wheel and thus it is commonly referred to as a grinding wheel. In coated abrasives, the binder serves to bond the abrasive grains to a substrate or backing, and the binder may be comprised of make and size coatings. In nonwoven abrasives, the binder serves to bond the abrasive grains to a lofty, open, fibrous substrate.

Abrasive binders typically comprise a glutinous or resinous adhesive, and, optionally, additional ingredients. Examples of resinous adhesives include phenolic resins, epoxy resins, urethane resins, acrylate resins and urea-formaldehyde resins. Examples of typical additives include grinding aids, fillers, wetting agents, surfactants, pigments, coupling agents, and dyes.

The addition of grinding aids may significantly affect the chemical and physical processes of abrading metals to bring about improved performance. It is believed that grinding aids either 1) decrease the friction between the abrasive grains and the workpiece being abraded, 2) prevent the abrasive grains from "capping", i.e., prevent metal particles from becoming welded to the tops of the abrasive grains, 3) decrease the interface temperature between the abrasive grains and the workpiece, or 4) decrease the required grinding force.

The abrasive industry is always evaluating means to improve the abrading efficiency of abrasive articles without unduly increasing their cost. It is desired to provide a means for utilizing a higher concentration of grinding aid in an abrasive product without significantly reducing the strength of the binder.

In recent years there has been a need to coat binder precursors exclusively from aqueous solutions or dispersions due to increasingly stringent pollution concerns. Accordingly, it is desired to provide abrasive articles having a peripheral coating comprising a grinding aid dispersed in a binder wherein the precursor of the binder can be coated from water or other aqueous compositions.

SUMMARY OF THE INVENTION

In accordance with the present invention an abrasive article is presented, and methods of making and using same.

In their broadest embodiment, the abrasive articles of the invention may be described as having a peripheral surface adapted to contact and abrade a workpiece, the abrasive article comprising a plurality of abrasive particles either 1) adhered together in a porous, shaped mass by a binder (thus defining a "bonded" abrasive; 2) adhered to a backing by a binder, thus defining a "coated" abrasive; or 3) adhered to the fibers of a lofty, open nonwoven web by a binder (thus defining a "nonwoven" abrasive. The abrasive article further comprises a grinding aid composition positioned at an effective location in reference to the abrasive particles, the grinding aid composition comprising:

a) a cured grinding aid binder comprising a blend of a thermoplastic resin and a thermoset resin, the thermoplastic resin and thermoset resin being present at an effective weight ratio; and b) an effective amount of a grinding aid dispersed (preferably uniformly) in the cured grinding aid binder.

Preferred abrasive articles in accordance with the invention are those wherein the thermoset resin comprises a cured epoxy resin, the thermoplastic resin comprises a low softening point, aliphatic or aromatic, nonpolar hydrocarbon resin, and wherein the grinding aid comprises a halide salt, particularly $KBF_4$.

The phrase "positioned at an effective location in reference to the abrasive particles" means that the grinding aid composition is positioned in the abrasive article in a manner such that during an abrading operation, the composition contacts or is sufficiently near the grinding interface to have a beneficial effect (i.e., an increase in abrading efficiency).

Particularly preferred abrasive articles within the invention are those wherein the abrasive article is a coated abrasive article and the grinding aid composition comprises a supersize coating. It is also within the invention to include the grinding aid composition within the size coating of a coated abrasive (either with or without a supersize coating) comprising the grinding aid composition. For example, if the size coating comprises the grinding aid composition, a conventional supersize coating may be employed or a supersize employing the grinding aid composition of the invention. Thus, the term "peripheral coating" when used in reference to coated abrasives means either a size or a supersize coating which is the outermost coating on the abrasive surface of the article.

As used herein the term "size coating" means a coating which substantially fills areas between protruding, exposed sharp points of abrasive particles of an abrasive article. The size coating may also, initially, partially or completely coat the abrasive particles. So-called "supersize" coatings are coatings which at least partially cover a size coating, and are the outermost binder coatings when present.

Also preferred are bonded abrasive articles comprising a plurality of abrasive particles adhered together in a porous, shaped mass by a binder, the bonded abrasive having a peripheral surface adapted to contact and abrade a workpiece. In these embodiments, the grinding aid composition may be present in pores of the bonded abrasive and/or on the peripheral surface.

The term "peripheral surface", when referring to coated and bonded abrasives, means that the abrasive articles of the invention have at least one surface adapted to or capable of being adapted to contact and abrade a workpiece. When referring to a nonwoven abrasive, the term means that a plurality of exposed fibers or fiber portions form the peripheral surface.

The terms "thermoset" and "thermoplastic" have their normal meaning in the polymer chemistry art. A "thermoset" resin is a cured resin that has been exposed to an energy source (e.g. heat and/or radiation) sufficient to make the resin incapable of flowing. The term "thermosetting" means an uncured thermoset resin. A "thermoplastic" resin is one which is capable of softening or flowing when heated and of hardening again when cooled.

The term "grinding aid" as used herein is meant to denote a particulate organic or inorganic ingredient which is dispersed in the blend of thermoplastic and thermoset resins. The term does not embrace the low thermoplastic resins described herein, although their may be a secondary grinding aid effect from the thermoplastic resin in that the thermoplastic resin may melt during grinding operations, allowing the thermoset resin to be more erodible, exposing more grinding aid.

"Dispersed" does not necessarily denote a uniform dispersion, but uniform dispersions of thermoplastic resin and grinding aids in thermoset resins are preferred.

An "effective weight ratio" of thermoplastic resin to thermoset resin defines a lower limit to the ratio below which the beneficial rheological and/or grinding efficiency effects of adding the thermoplastic resin are not seen. Similarly, "an effective amount of a grinding aid" is a lower threshold amount where a decrease in grinding aid below that amount is ineffective in increasing grinding efficiency. "Grinding efficiency" is defined as the weight of workpiece "cut" (i.e., removed) divided by the weight of abrasive article lost during a grinding operation.

The term "low softening point", when used in reference to the thermoplastic resins, is used as a means of characterizing these resins. Preferably the softening point (R & B) is no more than 150° C., more preferably no more than 100° C. Softening point is determined by a ring and ball test (R & B), which is described in more detail herein.

Another aspect of the invention is a coatable, stable grinding aid precursor composition comprising a thermosetting resin, a thermoplastic resin, and a grinding aid, the thermoplastic resin and the thermosetting binder precursor present in an effective weight ratio, the thermoplastic resin and the grinding aid dispersed in the thermosetting resin.

Especially preferred compositions within this aspect of the invention are those compositions comprising water and no or only a small percentage of organic solvent as a diluent, particularly those comprising no organic solvent, and wherein the composition is in the form of an anionic emulsion of a thermoplastic resin and an epoxy resin, further including $KBF_4$ as the grinding aid. The diluent, if organic, may be a reactive diluent, meaning that it may react with the thermosetting resin.

As used herein the term "coatable", when referring to grinding aid precursor compositions within the invention which are aqueous dispersions, emulsions, or solutions, means that the composition has a viscosity of at most about 3,000 centipoise (more preferably at most about 1000, most preferably at most about 500 centipoise) at 21° C. measured using a Brookfield viscometer, model ¼ RVT, using #6 spindle at 50 rpm. Coatable compositions within the invention may also be thixotropic "gels." The term "stable" means that compositions within the invention do not separate into two or more phases or polymerize into a non-coatable mass.

Another aspect of the invention is a method of making an abrasive article having a peripheral surface adapted to contact and abrade a workpiece, the abrasive composite comprising a plurality of abrasive particles and a binder, the method comprising:

a) applying to at least a portion of said abrasive particles a grinding aid precursor composition comprising a thermosetting resin, a thermoplastic resin, and a grinding aid, said thermoplastic resin and grinding aid dispersed in said binder precursor, said thermoplastic resin and said thermosetting binder precursor present in a predetermined weight ratio; and b) subjecting the grinding aid precursor composition to conditions sufficient to substantially cure said thermosetting resin.

A method of making a bonded abrasive article having a grinding aid therein is considered within this aspect of the invention. Bonded abrasive articles within this aspect of the invention comprise an abrasive composite in the form of a porous shaped mass. The porous shaped mass comprises a plurality of abrasive particles adhered together by a binder, the porous shaped mass having a plurality of randomly shaped voids defined by the binder and abrasive particles. At least a portion of the voids are at least partially filled with a grinding aid composition of the invention.

In one method of making a bonded abrasive article within this aspect of the invention, the grinding aid precursor composition is applied by immersing a base bonded abrasive article in the grinding aid precursor composition for a time sufficient for the composition to at least partially penetrate into the voids of the shaped mass. In another method, a base bonded abrasive article may be placed in a suitable holder, a low pressure area generated on one surface of the composite, and the grinding aid precursor composition drawn into the abrasive composite by vacuum. Alternatively, the grinding aid precursor composition may be forced into the voids by pressure.

A final aspect of the invention is a method of abrading a workpiece using the abrasive articles of the invention, particularly metals such as stainless steel, titanium, and the like.

Further aspects and advantages of the invention will become apparent from the following description of preferred embodiments end examples.

DESCRIPTION OF PREFERRED EMBODIMENTS

I. Coatable, Stable Grinding Aid Precursor Compositions

Previously known grinding aid supersize systems used on coated abrasives typically comprise an inorganic grinding aid, such as $KBF_4$, and a thermoset resin, such as an epoxy resin. The cured supersize coating was typically limited to about 72 weight percent $KBF_4$ due to coating methods and rheology of the uncured epoxy/$KBF_4$ composition.

The coatable, stable grinding aid precursor compositions of the present invention are a blend of a thermosetting resin, a low softening point thermoplastic resin, a grinding aid, and optional ingredients. The compositions surprisingly allow higher weight percentages of grinding aid to be coated onto abrasive articles than previously known compositions. Surprisingly, the presence of the thermoplastic resin appears to allow the grinding aid to be present in the grinding aid composition in an amount of at least 75 weight percent based on weight of the grinding aid composition, more preferably at least 85 weight percent. In some formulations of the invention, the grinding aid maybe present at 90 weight percent of the total weight of the grinding aid composition.

A. Thermosetting Resins

Thermosetting resins useful in the inventive grinding aid precursor compositions are those capable of functioning, when cured, as the primary means of bonding grinding aid particles to an abrasive article, or within a coating over abrasive particles.

Thermosetting resins useful in the invention include epoxy resins, phenolic resins, urea-aldehyde resins, aminoplast resins having pendant unsaturated carbonyl groups, and the like, (including those having at least 1.1 pendant alpha, beta unsaturated carbonyl group per molecule or oligomer as described in U.S. Pat. No. 4,903,440, which is hereby incorporated by reference); acrylated resins such as isocyanurate resins having at least one pendant acrylate group (such as the triacrylate of tris(hydroxyethyl) isocyanurate), acrylated urethane resins, acrylated epoxy resins, and isocyanate derivatives having at least one pendant acrylate group. It is to be understood that mixtures of the above resins could also be employed. The term "acrylated" is meant to include monoacrylated, monomethacrylated, multi-acrylated, and multi-methacrylated monomers, oligomers and polymers.

The term "epoxy resin" as used herein means an uncured resin which does not include a curing agent, whereas the term "cured epoxy resin" denotes a solidified reaction product of oxirane rings with curing agents. Epoxy resins include resins comprised of monomers, oligomers, and polymers containing one or more oxirane rings. The oxirane ring reacts by ring opening, which is not considered a condensation reaction, but rather an opening of the oxirane ring by initiated by acidic or basic catalysts.

Epoxy resins may vary greatly in the nature of their backbones and substituent groups. For example, the backbone may be of any type such that there is an active hydrogen atom which is reactive with an oxirane ring at room temperature (about 25° C.). Representative examples of acceptable substituent groups include halogens, ester groups, ether groups, sulfonate groups, siloxane groups, nitro groups, and phosphate groups.

The molecular weight of the epoxy resins useful in the invention may vary from about 60 to about 4000, and preferably range from about 100 to about 600. Mixtures of various epoxy-containing materials may be used in the compositions of the invention.

Preferred epoxy resins are aqueous emulsions and organic solvent dispersions. Suitable aqueous epoxy emulsions for use in the invention are compositions comprising glycidyl ether monomers within the general formula

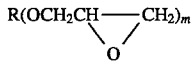

wherein R is alkyl or aryl and m is an integer ranging from 1 to about 6, inclusive. Representative examples of these are the glycidyl ethers of polyhydric phenols obtained by reacting a polyhydric phenol with an excess of a chlorohydrin, such as epichlorohydrin. Specific examples of preferred epoxy resins lacking ethylenically unsaturated groups include 2,2-bis[4-(2,3-epoxypropoxyl)phenyl] propane (diglycidyl ether of bisphenol A) and commercially available materials under the trade designation "Epon 828", "Epon 1004" and "Epon 1001F" available from Shell Chemical Co., "DER-331", "DER-332" and "DER-334" available from the Dow Chemical Co. Other suitable epoxy resins lacking ethylenically unsaturated groups include glycidyl ethers of phenol formaldehyde novolak resins (e.g., "DEN-431" and "DEN-438" available from the Dow Chemical Co.), and resorcinol diglycidyl ether. Additional examples of epoxides of this type that can be used in the practice of this invention are described in U.S. Pat. No. 3,018,262, incorporated herein by reference.

Especially preferred for use in the present invention is the diglycidyl ether of bisphenol A having an epoxy equivalent weight (molecular weight divided by number of epoxy groups) ranging from about 500 to 1000. Preferably, aqueous epoxy emulsions of this type have from about 50 to about 70% solids, and further comprise a nonionic emulsifier. A composition meeting this description is available under the trade designation "CMD 35201", available from Rhone Poulenc, Inc., Louisville, Ky., which has an epoxy equivalent weight ranging from about 600 to about 700.

Organic solvent dispersions of epoxy resins useful in the invention may also comprise diglycidyl ethers of bisphenol A epoxy resin and an organic solvent such as that known under the trade designation "Aromatic 100", commercially available from Worum Chemical Co., St. Paul, Minn., which consists of a mixture of aromatic hydrocarbons. Epoxy equivalent weights for resins meeting this description typically and preferably have an epoxy equivalent weight ranging from about 100 to about 500. One particularly preferred epoxy resin which may be combined with an organic solvent to form a coatable composition within the invention is that known under the trade designation "EPON 828", previously mentioned, which has an epoxy equivalent weight ranging from about 185 to about 195.

As noted, epoxy resins of the type useful in the invention require curing agents which react with the oxirane groups of the epoxy resin to form crosslinked binders. Curing agents useful in the invention are typically and preferably selected from amides and imidazoles. One useful amide is the polyamide known under the trade designation "VERSAMID 125", commercially available from Henkel Corporation. A useful imidazole is that known under the trade designation "EMI-24", commercially available from Air Products, Allentown, Pa., which is a 100 percent solids version of 2-ethyl-4-methyl imidazole. This imidazole is typically and preferably diluted with water when used with aqueous epoxy resins. A preferred imidazole has from about 10 to 40 percent solids, more preferably about 25 percent solids. When used with organic solvent dispersions of epoxy resins, the imidazole is typically and preferably used as 100 percent solids.

Phenolic resins and urea-aldehyde resins useful in the invention as thermosetting resins include those disclosed U.S. Pat. No. 5,178,646, columns 15–17, incorporated herein by reference. These resins comprise the reaction product of an aldehyde and a non-aldehyde. Phenolic resins are preferred because of their thermal properties, availability, low cost, and ease of handling. The general term "phenolic" includes phenol-formaldehyde resins as well as resins comprising other phenol-derived compounds and aldehydes. The phenolic and urea-aldehyde resins preferably are 30–95% solids, more preferably 60–80% solids, with a viscosity ranging from about 750 to about 1500 cps (Brookfield viscometer, number 2 spindle, 60 rpm, 25° C.) before addition of any diluent, and have molecular weight (number average) of at least about 200, preferably varying from about 200 to 700.

Resole phenolic resins can be catalyzed by alkaline catalysts, and the molar ratio of formaldehyde to phenol is greater than or equal to one, typically between 1.0 to 3.0, thus presenting pendant methylol groups. Alkaline catalysts suitable for catalyzing the reaction between aldehyde and phenolic components of resole phenolic resins include sodium hydroxide, barium hydroxide, potassium hydroxide, calcium hydroxide, organic amines, and sodium carbonate, all as solutions of the catalyst dissolved in water. A general discussion of phenolic resins and their manufacture is given in Kirk-Othmer, *Encyclopedia of Chemical Technology*, 3rd Ed., John Wiley & Sons, 1981, N.Y., Vol. 17, p. 349-et. seq., incorporated herein by reference.

In accordance with the teachings of the '646 patent mentioned above, the uncured resole phenolic resin may be combined with a reactive diluent having the properties and structure described therein.

Aldehydes which are useful as components of thermosetting resins useful in the coatable, stable grinding aid binder precursor compositions of the present invention include cyclic, straight and branched chain alkyl aldehydes, which can be saturated or unsaturated, and aromatic aldehydes. Preferably, the aldehydes have molecular weight below about 300 to afford a less viscous binder precursor solution. Examples of suitable aldehydes include formaldehyde, benzaldehyde, propanol, hexanal, cyclohexane carboxaldehyde, acetaldehyde, butyraldehyde, valeraldehyde, and other low molecular weight aldehydes. Preferred is formaldehyde, for its availability, low cost, cured resin properties, and because it affords low viscosity grinding aid precursor compositions.

Examples of commercially available phenolic resins useful in the invention include those known by the trade names "Varcum" (from Durez Division of Occidental Chemical Corp.), "Aerofene" (from Ashland Chemical Co.), and "Bakelite" (from Union Carbide). A standard, 70% solids (1.96:1.0 molar ratio of formaldehyde to phenol) phenolic resin having 2 weight percent KOH per weight of phenol is available from Neste Resins Canada, Mississauga, Ontario, Canada.

B. Thermoplastic Resins

Thermoplastic resins useful in the invention are those having the capability of functioning to increase grinding efficiency of abrasive articles when applied as a component of a grinding aid composition. Although not wishing to be bound by any particular theory, it is believed by the inventor herein that the thermoplastic resin softens or melts at the grinding interface, making for more efficient use of available grinding aid through a heat induced erosion of the thermoset binder.

Surprisingly, and quite unexpectedly, those thermoplastic resins selected for their effectiveness in the grinding aid composition were also found to reduce the viscosity and increase the stability (reduce phase separation) of grinding aid precursor compositions of the invention. Perhaps more importantly, the useful thermoplastic resins unexpectedly allowed an increased concentration of grinding aid in grinding aid precursor compositions of the invention without compromising the stability of the compositions.

Thermoplastic resins useful in the invention comprise organic oligomers or polymers, preferably nonpolar organic polymers having softening point (R & B) less than about 150° C. The thermoplastic resin is typically and preferably dissolved or dispersed in an organic solvent such as that known under the trade designation "Aromatic 100", previously mentioned, and the like.

The ring and ball softening point refers to the softening point of the "base" thermoplastic resin only, i.e., without any organic solvent, water, or emulsifier. The ring and ball softening temperatures of the thermoplastic resins useful in the invention are determined by a modified ASTM E 28 procedure, which is incorporated herein by reference except for the modification discussed below. The softening point, as determined by this method, is the temperature at which a disk of the composition being tested held within a horizontal ring is forced downward a distance of 1 inch (2.54 cm) under the weight of a steel ball as the sample is heated at a rate of 5° C. per minute in a water or glycerin bath. (A water bath is used for resins having softening points below 80° C., while a glycerine bath is employed for resins having softening points above 80° C.)

The apparatus used in the test conforms to all ASTM specifications defined in ASTM E 28 with one exception: the procedure used herein does not use a mechanical stirrer. The mixing of water or glycerin is achieved solely by the convection currents generated by a low-flame from a Fisher burner. The burner is positioned beneath the beaker slightly off-center toward the analyst.

One class of examples of suitable thermoplastic resins for use in the present invention include those known under the trade designations "Piccolastic A75", "Picco 6100", and "Picco 5140" all solids at room temperature and all commercially available from Hercules Inc., Wilmington, Del. "Piccolastic A75" is a low molecular weight thermoplastic polystyrene resin, and "Picco 6100" and "Picco 5140" are low molecular weight, nonpolar, aromatic thermoplastic polymerized resins derived from $C_7$ to $C_9$ monomers. Their R & B softening points are, respectively, 75° C., 100° C., and 140° C.

Other thermoplastic resins useful in the invention include those known under the trade designations "Tacolyn 1085", "Piccotex LC-55WK", and "Piccotac 95-55WK", which are aqueous, 55 percent solids, organic solvent-free, resin dispersions commercially available from Hercules Inc., Wilmington, Del. "Piccotex LC-55WK" is an anionic dispersion of a polymerized resin known under the trade designation "Piccotex LC" (also from Hercules) derived from copolymerizing vinyl toluene and alpha-methyl styrene. "Piccotac 95-55WK" is a dispersion of a polymerized aliphatic hydrocarbon resin known under the trade designation "Piccotac 95", also from Hercules. The anionic emulsifier for the latter two dispersions is reported to be the potassium soap of rosin. The R & B softening point of the base resin of these three dispersions is, respectively, 85° C., 90° C., and 95° C.

The weight ratio of thermoplastic resin to thermosetting resin in the grinding aid precursor compositions, on a solids basis, is the same as the weight ratio in the cured grinding aid binder of the abrasive articles of the invention. This weight ratio typically and preferably is at least 0.1:1.0, more preferably at least 0.3:1.0.

C. Grinding Aids

Grinding aids, as mentioned in the Background of the Invention, function to either 1) decrease the friction between abrasive grains and the workpiece being abraded, 2) prevent the abrasive grains from "capping", i.e., prevent metal particles from becoming welded to the tops of the abrasive grains, 3) decrease the interface temperature between abrasive grains and the workpiece, or 4) decrease the required grinding force.

Grinding aids useful in the invention may comprise materials selected from the group consisting of inorganic halide salts, halogenated compounds and polymers, and organic and inorganic sulfur-containing materials.

Preferred are halide salts, particularly potassium tetrafluoroborate ($KBF_4$), cryolite ($Na_3AlF_6$), ammonium cryolite [$(NH_4)_3AlF_6$], and the like.

Examples of halogenated polymers useful as grinding aids include polyvinyl halides and polyvinylidene halides such as disclosed in U.S. Pat. No. 3,616,580; highly chlorinated paraffin waxes such as those disclosed in U.S. Pat. No. 3,676,092; completely chlorinated hydrocarbons resins such as those disclosed in U.S. Pat. No. 3,784,365; and fluorocarbons such as polytetrafluoroethylene and polytrifluorochloroethylene as disclosed in U.S. Pat. No. 3,869,834, and the like.

Inorganic sulfur-containing materials preferred for use in the invention as grinding aids include elemental sulfur, cupric sulfide, molybdenum sulfide, potassium sulfate, and the like, as variously disclosed in U.S. Pat. Nos. 3,833,346; 3,868,232; and 4,475,926. Organic sulfur-containing materials for use in the invention include those mentioned in U.S. Pat. No. 3,058,819, including thiourea, and the like.

The grinding aid is preferably present in the dried, cured, grinding aid composition in an amount of at least 75 weight percent based on weight of the cured composition, more preferably at least about 85 weight percent.

Grinding aids useful in the invention are particles having an average particle size ranging from about 1 micrometer to about 100 micrometers, more preferably ranging from about 5 micrometers to about 50 micrometers. The grinding aid particles may be individual particles or comprise an agglomerate of individual particles, such as disclosed in Patent Cooperation Treaty application U.S. Ser. No. 91/06389, published Apr. 16, 1992 (Cosmano et al).

D. Diluents

Diluents may also be used in the grinding aid precursor compositions of the invention. As used herein the term "diluent" connotes water or a low molecular weight (less than 500) organic material that decreases the viscosity of the grinding aid precursor to which they are added. Diluents may be reactive with the thermosetting resin or inert.

Low molecular weight acrylates are one preferred type of reactive diluent. Acrylate reactive diluents preferred for use in the invention typically have a molecular weight ranging from about 100 to about 500, and include ethylene glycol diacrylate, ethylene glycol dimethacrylate, hexanediol diacrylate, triethylene glycol diacrylate, trimethylolpropane triacrylate, and the like.

Other useful reactive diluents include monoallyl, polyallyl, and polymethallyl esters and amides of carboxylic acids (such as diallyl phthalate, diallyl adipate, and N,N-diallyladipamide); tris(2-acryloyloxyethyl)isocyanurate, 1,3,5-tri(2-methacryloxyethyl)-s-triazine, acrylamide, methylacrylamide, N-methylacrylamide, N,N-dimethylacrylamide, N-vinylpyrrolidone, and N-vinylpiperidone.

Still other useful reactive diluents, especially when the thermosetting resin is a phenolic or urea-aldehyde resin, are urea derivatives, alkyl substituted 2-aminoalcohols, poly(oxyalkylene) compounds, and others disclosed in U.S. Pat. No. 5,178,646, incorporated herein by reference.

The reactive diluent, if used, is preferably premixed with the thermosetting resin for preparing the coatable, stable grinding aid precursor compositions of the invention. However, when some reactive diluents, such as the poly(oxyalkylene) compounds, are used with phenolic and urea-aldehyde resins, the thermosetting resin may be premixed with a quantity of water sufficient to absorb some of the exothermic heat evolved when the poly(oxyalkylene) compound is mixed with the resin.

The weight ratio of thermosetting resin to reactive diluent can range from about 2:1 to about 100:1 for all reactive diluents useful in the invention, and from about 1:1 to about 100:1 for poly(oxyalkylene) reactive diluents.

Both water and organic solvents may be employed, or a combination of water and organic solvent. One useful organic solvent is that mentioned previously having the trade designation "Aromatic 100", from Worum Chemical Company.

The amount of diluent to be added to the grinding aid precursor composition depends on the desired viscosity of the composition. In embodiments wherein emulsions of thermosetting and/or thermoplastic resins are employed, less diluent will ordinarily be required. The preferred amount to add in each embodiment is deemed to be within the knowledge of the skilled artisan without undue experimentation.

E. Thixotropic Agents

In some embodiments, such as when an organic solvent dispersion of thermosetting and/or thermoplastic resins are to be employed, it may be desirable to add a small amount of a thixotropic agent to the grinding aid precursor compositions of the invention to increase the viscosity. This may also be desirable in embodiments wherein the peripheral coating is desired to be deposited in a pattern on the abrasive article. In some instances better grinding efficiency may result if a pattern coating of grinding aid is used.

Preferred thixotropic agents are colloidal silicas, added to the grinding aid precursor composition at a weight ratio ranging from about 1 to about 5 weight percent.

F. Optional Additives

Grinding aid precursor compositions within the invention may, and typically do contain optional additives. These additives include fillers (other than grinding aids), fibers, lubricants, wetting agents, surfactants, pigments, dyes, coupling agents, plasticizers and suspending agents. In some cases there may be a beneficial synergistic effect on abrading performance or a reduction in cost when optional fillers, such as calcium carbonate, are employed. The amounts of these optional materials are selected to provide the properties desired.

II. Abrasive Articles

Abrasive articles within the invention may be any article which might benefit from the presence of a grinding aid during grinding of a workpiece, particularly metal workpieces. Thus, a nonlimiting list of abrasive articles includes coated abrasives (belts, discs, sheets and the like), bonded abrasives (particularly grinding wheels and cut-off discs), nonwoven abrasives, abrasive filaments, and the like.

A. Coated Abrasives

In the case of coated abrasives, an abrasive composite is bonded to at least one surface of a backing. The backing can be any number of various materials conventionally used as backings in the manufacture of coated abrasives, such as paper, cloth, film, vulcanized fiber, woven and nonwoven materials, and the like, or a combination of two or more of these materials or treated versions thereof. The choice of backing material will depend on the intended application of the abrasive article. The strength of the backing should be sufficient to resist tearing or other damage in use, and the thickness and smoothness of the backing should allow achievement of the product thickness and smoothness desired for the intended application. The adhesion of the abrasive composite to the backing should also be sufficient to prevent significant shedding of individual abrasive particles or the abrasive coating during normal use. In some applications it is also preferable that the backing be waterproof. The thickness of the backing should be sufficient to provide the strength desired for the intended application; nevertheless, it should not be so thick as to affect the desired flexibility in the coated abrasive product. It is preferred that the backing be a polymeric film, such as polyester film, for lapping coated abrasives, and that the film be primed with a material, such as ethylene acrylic acid copolymer, to promote adhesion of the abrasive composite thereto.

In the case of a woven backing, it is sometimes preferable to fill the interstices of the backing with at least one coating before the application of the coatings which form the abrasive composite. Coatings used for this purpose are called saturant, back or presize coatings, depending on how and to what surface of the backing the coating is applied.

The backing may comprise a laminate of backings made by laminating two or more plies of either similar or dissimilar backing materials.

The surface of the backing not containing the abrasive composite may also contain an adhesive or a hook and loop type attachment system so that the abrasive article can be secured to a back-up pad. Examples of adhesives suitable for this purpose include rubber-based adhesives, acrylate-based adhesives, and silicone-based adhesives.

Coated abrasives in accordance with the invention may be made using make and size coatings which bind abrasive particles to the surface of the backing, and optionally may include supersize coatings. In embodiments wherein the inventive grinding aid precursor composition is used to form a part or all of the size coating, the make coating preferably comprises a binder which is compatible with the thermoset and thermoplastic resins of the inventive size coating. Similarly, in embodiments wherein the inventive grinding aid precursor composition is used to form a supersize coating, the size coating preferably comprises a binder which is compatible with the thermoset and thermoplastic resins of the inventive supersize coating. The make, size and supersize coatings may comprise the same or different binders. It may be preferred to include the grinding aid composition of the invention in both the size and supersize coatings.

As was discussed above in reference to the grinding aid precursor compositions of the invention, the make, size, and supersize coatings may, and typically do contain optional additives such as fillers (other than grinding aids), fibers, lubricants, wetting agents, surfactants, pigments, dyes, coupling agents, plasticizers and suspending agents. As previously noted, the amounts of these optional materials are selected to provide the properties desired.

The other binder coatings can be any of the traditional adhesive resins used in abrasive articles, such as the above-referenced phenolic resins, aminoplast resins, urethane resins, lattices, epoxy resins, urea-aldehyde resins, isocyanurate resins, and mixtures thereof.

Methods of making coated abrasives within the invention include those wherein make, size, and optional supersize coatings are employed, and those wherein a slurry comprised of abrasive particles and a binder precursor is applied to a backing and subjected to conditions sufficient to cure the binder precursor. A method of making preferred coated abrasives within the invention employing make, size and supersize coatings is given in the Examples hereinafter. In each case the grinding aid precursor composition of the invention is applied only as the supersize coating and is not present in any other coating.

B. Bonded Abrasives

Abrasive products comprising a solid or foamed organic polymeric matrix having abrasive granules dispersed throughout and bonded therein may employ the grinding aid composition of the invention. The grinding aid precursor composition may be applied either as a peripheral surface coating or to voids within the bonded abrasive, as previously discussed. Typically, the polymeric matrix of the base bonded abrasive (i.e., without the grinding aid composition of the invention) is composed of either a hard, thermoset resin, such as a catalyzed phenol-formaldehyde, or resilient elastomer, such as a polyurethane or a vulcanized rubber.

When elastomeric binder matrices are used in bonded abrasives they generally produce an abrasive article having some degree of flexibility and resiliency. These abrasive articles typically provide a smoother abrasive action and a finer surface finish than that provided by a bonded abrasive article made with hard, thermoset resin.

Conventional flexible bonded abrasive articles typically employ an elastomeric polyurethane as the binder matrix. The polyurethane binder matrix may be a foam, as disclosed in U.S. Pat. Nos. 4,613,345, 4,459,779, 2,972,527, 3,850,589; UK Patent Specification No. 1,245,373 (published Sep. 8, 1971); or the polyurethane binder may be a solid, as disclosed in U.S. Pat. Nos. 3,982,359, 4,049,396, 4,221,572, and 4,933,373.

Bonded abrasives useful in the invention may comprise synthetic polymers comprising the reaction product of polyisocyanates and oligomeric aminobenzoic acid esters and amines and processes for their preparation have been suggested for use as a binder for bonded abrasive articles in assignee' copending patent application Ser. No. 07/907,223 (Nelson). U.S. Pat. No. 4,328,322 describes such polymers. Bonded abrasives may also be molded from polyurethanes and polyurethane/ureas crosslinked with 2-glyceryl acrylate or 2-glyceryl methacrylate as disclosed in U.S. Pat. No. 4,786,657. This patent describes the use of high equivalent weight diols and diamines, 2-glyceryl acrylate, diisocyanates, and low equivalent weight glycols and diamines in the production of polyurethanes and polyurethane/ureas.

Bonded abrasives of the invention preferably have voids which, besides being partially filled with grinding aid, allow heat to be dissipated and present new abrasive particles to the workpiece, as well as allow workpiece material and/or abrasive composition material a "relief area", i.e., an area to flow when broken away.

The voids and degree of openness of the bonded abrasives of the invention are affected by the weight ratio of abrasive particles to binder employed, and the physical and chemical attributes of the abrasive particles. If preformed abrasive agglomerates are employed, the preformed abrasive agglomerates are preferably present at a weight ratio ranging from about 2:1 to about 10:1 referenced to weight of binder matrix, and more preferably from about 3.5 to 1. Agglomerates are particularly preferred for those applications requiring a higher rate of cut. Preferably, the agglomerates range in size from about 0.20 to about 2.0 millimeters.

Within some degree of freedom, it is possible to adjust the density of the bonded abrasive articles of the invention by controlling the relative amounts of abrasive material and binder mixture placed in a given mold cavity, and by using a mixture of agglomerated and non-agglomerated abrasive particles. Addition of more abrasive and binder mixture in the same cavity followed by forced compaction of the mixture produces a wheel or other article having a higher density. Base bonded abrasives useful in the invention preferably have densities ranging from about 1.0 to about 3.0 g/cm$^3$.

Bonded abrasive articles incorporating the grinding aid compositions of the invention as peripheral surface coatings and/or within voids can be used for deburring and finishing of metals. These abrasive articles may be formulated into a variety of conventional forms such as wheels, points, discs, cylinders and belts. The preferred articles are in the form of wheels and discs. The wheels typically have a central opening for mounting on an appropriate arbor or other mechanical holding means to enable the wheel to rotate in use. Wheel dimensions, configurations, means of support, and means of rotation are well-known in the art.

The base bonded abrasives of the present invention can be made by any of a variety of methods depending on the shape of the article to be formed and whether a backing is utilized. The abrasive particle-liquid mixture can be cast molded, transfer molded, liquid injection molded, reaction injection molded or molded using other techniques well known to those skilled in the art. The preferred method of forming the base bonded abrasives to which the grinding aid precursor is applied is transfer molding. In general, this method may be described in two steps:

(a) combining a curable, preferably smear-resistant elastomeric binder precursor with an effective amount of abrasive particles to form a curable abrasive mixture; and (b) curing the binder precursor to form the bonded abrasive composition.

Exemplary methods of making base bonded abrasives include those methods wherein the mixture is introduced into a mold before curing and also those methods where the mixture is applied to a preformed backing before curing. Other preferred methods include those wherein the binder is a polyurea binder made using a polyfunctional amine which is an oligomeric aromatic polyfunctional amine, and wherein preformed agglomerates of individual abrasive particles are used, such as those disclosed in U.S. Pat. No. 4,799,939.

The particularly preferred method of curing is by heating the mixture for a time and at a temperature and pressure sufficient to cure the mixture. The time, temperature, and pressure are interrelated, and various combinations will produce base bonded abrasives to which the grinding aid precursor composition may be applied.

After the base bonded abrasive article has been formed, the grinding aid precursor composition may be applied to the peripheral surface of the article by conventional methods such as roll coating, brush coating, and the like. In embodiments wherein the grinding aid precursor is to be applied to voids in the article, the base bonded abrasive article, such as a grinding wheel with a central arbor hole, is preferably immersed in a holder containing grinding aid precursor composition which allows the composition to be forced by vacuum into the voids. Alternatively, the grinding aid precursor composition may be forced into the voids via pressure, for example by immersing the base bonded abrasive article in a container of the grinding aid precursor composition and pressurizing the container with an inert gas.

C. Nonwoven Abrasives

Nonwoven abrasive articles are generally illustrated in U.S. Pat. No. 2,958,593, incorporated herein by reference. In general they comprise open, lofty, three-dimensional webs of organic fibers bonded together at points where they contact by an organic binder. These webs may be roll coated, spray coated, or coated by other means with the grinding aid precursor compositions of the invention, and subsequently subjected to thermal conditions sufficient to cure the thermosetting resin.

D. Abrasive Partiales

Individual abrasive particles useful in the above abrasive articles of the invention may be selected from those commonly used in the abrasive art, however, the abrasive particles (size and composition) will be chosen with the application of the abrasive article in mind. In choosing an appropriate abrasive particle, characteristics such as hardness, compatibility with the intended workpiece, particle size, reactivity with the workpiece, as well as heat conductivity may be considered.

The composition of abrasive particles useful in the invention can be divided into two classes: natural abrasives and manufactured abrasives. Examples of natural abrasives include: diamond, corundum, emery, garnet, buhrstone, chert, quartz, sandstone, chalcedony, flint, quartzite, silica, feldspar, pumice and talc. Examples of manufactured abrasives include: boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride.

Abrasive particles useful in the invention typically and preferably have a particle size ranging from about 0.1 micrometer to about 1500 micrometers, more preferably ranging from about 10 micrometers to about 1300 micrometers. The abrasive particles preferably have an average particle size ranging from about 20 micrometers to about 1000 micrometers. It is preferred that abrasive particles used in the invention have a Moh's hardness of at least 8, more preferably above 9; however, for specific applications, softer particles may be used.

The term "abrasive particle" includes agglomerates of individual abrasive particles, which are particularly preferred in bonded abrasive articles within the invention. An abrasive agglomerate is formed when a plurality of abrasive particles are bonded together with a binder to form a larger abrasive particle which may have a specific particulate structure. The plurality of particles which form the abrasive agglomerate may comprise more than one type of abrasive particle, and the binder used may be the same as or different from the binders used to bind the agglomerate to a backing.

III. Methods of Abrading

The particular method of using an abrasive article of the invention to abrade a workpiece depends in general on the surface finish desired and/or the amount of workpiece to be removed.

Coated abrasives within the invention are particularly well suited for abrading metals, including exotic metals such as stainless steel and titanium. As used herein the term "abrading" is used generally to include grinding, polishing, finishing and the like.

Prior to the advent of the present invention it was generally known in the abrasives art that grinding efficiency generally increases as the amount of grinding aid present at the grinding interface increases. However, when a grinding aid composition comprising a grinding aid, a thermosetting resin, and a thermoplastic resin was added to the size or supersize (or both) of a coated abrasive article of the invention, it was unexpected and quite surprising to see the large increase in efficiency reported in the Examples. The increase was particularly noticeable when aqueous epoxy resins as described above were employed as the thermosetting resin.

The most generic method within the invention of abrading metal workpieces comprises contacting the workpiece with a peripheral surface of an abrasive article, as defined previously, with sufficient force to abrade the metal workpiece while the peripheral surface and workpiece are moving in relation to each other. The abrasive article comprises a grinding aid composition in substantial contact with the abrasive particles. Either the workpiece or the abrasive article is preferably stationary, although this is not a requirement of the method.

A general reference for grinding of metals, except for the teaching of use of the grinding aid compositions described herein, is Chapter 7 of the book entitled "Coated Abrasives—Modern Tool of Industry", pp. 150–200, published by the Coated Abrasives Manufacturers' Institute in 1958. As stated therein, for each application, there is an optimum combination of a particular kind of coated abrasive used in a specific grade sequence and the right type of equipment which will give the best results in terms of production, finish, and cost. Factors to be considered are the metallurgy of the workpiece, the shape, size, and condition of the workpiece, the power of the equipment to be used, type of contact wheel used, and the desired finish.

In embodiments wherein the abrasive article is a continuous abrasive belt, the choice of contact wheel, force employed, and abrasive belt speed depends on the desired rate of cut and the resulting surface finish on the workpiece, care being taken not to damage the workpiece. The contact wheel may be plain or serrated. The force between the abrasive article and the workpiece may range from 0.05 kilogram (kg) to 150 kg, typically and preferably from about 0.1 kg to about 100 kg. The belt speed may range from 1000 surface feet per minute (sfpm) to 10,000 sfpm, more typically and preferably from about 3000 to about 7000 sfpm.

To better illustrate the use of abrasive articles of the invention (particularly coated abrasive belts) in abrading stainless steel, the following test procedure was used.

TEST PROCEDURE

The coated abrasive article of each of the following examples was converted into 7.6 cm by 335 cm endless abrasive belts. Two belts from each example were tested on a constant load surface grinder. A pre-weighed, 304 stainless steel workpiece approximately 2.5 cm by 5 cm by 18 cm was mounted in a holder, positioned vertically, with the 2.5 cm by 18 cm face confronting approximately 36 cm diameter 60 Shore A durometer serrated rubber contact wheel and one to one lands over which entrained the coated abrasive belt. The workpiece was then reciprocated vertically through a 18 cm path at the rate of 20 cycles per minute, while a spring-loaded plunger urged the workpiece against the belt with a load of 11.0 kg as the belt was driven at about 2,050 meters per minute. After thirty seconds of grinding time had elapsed, the workpiece holder assembly was removed and reweighed, the amount of stock removed calculated by subtracting the weight after abrading from the original weight. Then a new, pre-weighed workpiece and holder were mounted on the equipment. The experimental error on this test was ~10%. The total cut is a measure of the total amount of stainless steel removed throughout the test. The test was deemed ended when the amount of final cut was less than one third the amount of initial cut of the comparative belt for two consecutive thirty-second intervals.

The following non-limiting examples will further illustrate the invention. All parts, percentages, and ratios are based upon weight unless indicated otherwise. The following material designations will be used.

EXAMPLES

Materials Description

Epoxy Resins

BPAW: A composition containing a diglycidyl ether of bisphenol A epoxy resin coatable from water containing approximately 60% solids and 40% water. This composition, which had the trade designation "CMD 35201", was purchased from Rhone Poulenc, Inc., Louisville, Ky. This composition also contained a nonionic emulsifier. The epoxy equivalent weight ranged from about 600 to about 700.

BPAS: A composition containing a diglycidyl ether of bisphenol A epoxy resin coatable from an organic solvent. This composition, which had the trademark "EPON 828", was purchased from the Shell Chemical Company, Houston, Tex. The epoxy equivalent weight ranged from about 185 to about 195.

Phenolic Resin

RPR: A resole phenolic resin with 75% solids (non-volatile).

Curing Agents

EMI: A 100% solids composition of 2-ethyl-4-methyl imidazole. This curing agent, which had the designation "EMI-24", was commercially available from Air Products, Allentown, Pa.

PA: A polyamide curing agent, having the trade designation "VERSAMID 125", commercially available from Henkel Corporation.

Grinding Aid

KBF4: 98% pure micropulverized potassium tetrafluoroborate, in which 95% by weight passes through a 325 mesh screen and a 100% by weight passes through a 200 mesh screen.

Dispersing Agent

AOT: A dispersing agent (sodium dioctyl sulfosuccinate), which had the trade designation "Aerosol OT" was commercially available from Rohm and Haas Company.

Thixotropic Thickener

CAB M5: A colloidal silica having the trade designation "Cab O-Sil M-5", commercially available from Cabot Corp., Tuscola, Ill.

Coupling Agent

TTS: An organotitanate having the trade designation "Ken React KR-TTS", commercially available from Kenrich Petrochemical Inc., Bayonne, N.J.

Solvent

WC100: An organic solvent consisting of aromatic hydrocarbons, having the trade designation "AROMATIC 100", commercially available from Worum Chemical Co., St. Paul, Minn.

Thermoplastic resins

PA75: A low molecular weight thermoplastic polystyrene resin having the trade designation "Piccolastic A75", commercially available from Hercules Inc., Wilmington, Del.

P6100: A low molecular weight, nonpolar, thermoplastic resin derived from petroleum-derived monomers having the trade designation "Picco 6100", commercially available from Hercules, Inc., Wilmington, Del.

P5140: A low molecular weight, nonpolar, thermoplastic resin produced from petroleum derived monomers having the trade designation "Picco 5140", commercially available from Hercules Inc., Wilmington, Del.

T1085: An aqueous, 55% solids, solvent free, synthetic resin dispersion having the trade designation "Tacolyn 1085", commercially available from Hercules Inc., Wilmington, Del.

PT95: A 55% solids content, anionic, solvent free dispersion of Piccotac 95 resin, an aliphatic hydrocarbon resin, having the trade designation "Piccotac 95-55WK", commercially available from Hercules Inc., Wilmington, Del.

PTLC: A 55% solids content, anionic, solvent-free dispersion of Piccotex LC resin, a hydrocarbon resin produced by copolymerizing vinyl toluene and alpha-methyl styrene, having the trade designation "Piccotex LC-55WK", commercially available from Hercules Inc., Wilmington, Del.

General Procedure for Making Coated Abrasives

For the following examples made using this procedure, the backing of each coated abrasive consisted of a Y weight woven polyester cloth which had a four over one weave. Each backing was saturated with a latex/phenolic resin and then placed in an oven to partially cure this resin. Next, a calcium carbonate-filled latex/phenolic resin pretreatment coating was applied to the back side of each backing. Each coated backing was heated to about 120° C. and maintained at this temperature until the resin had cured to a tack-free state. Finally, a pretreatment coating of latex/phenolic resin was applied to the front side of each coated backing and each coated backing was heated to about 120° C. and maintained at this temperature until the resin had pre-cured to a tack-free state. Each backing made by this procedure was completely pretreated and was ready to receive a make coat.

A coatable mixture for producing a make coating for each coated backing was prepared by mixing 69 parts of 70% solids phenolic resin (48 parts phenolic resin), 52 parts non-agglomerated calcium carbonate filler (dry weight basis), and enough of a solution of 90 parts water/10 parts ethylene glycol monoethyl ether to form a make coating in each case which was 84% solids, with a cured coating weight of 243 g/m$^2$. The make coating was applied in each case via two-roll coating. (It will be appreciated that other coating methods, such as knife coating, curtain coating, spray coating, and the like, may have been used as well. Also, the number of rolls in roll coating is not required to be two.)

Next, grade 36 (ANSI standard B74.18 average particles size of 545 micrometers) aluminum oxide abrasive particles was drop coated onto the uncured make coatings with a weight of 423 g/m$^2$, followed by an electrostatic application of grade 36 ceramic aluminum oxide with a weight of 455 g/m$^2$.

Then the resulting constructions received a precure of 15 minutes at 65° C. followed by 75 minutes at 88° C.

A 82% solids coatable mixture suitable for forming a size coating (having the compositions described in the following examples) was then applied over the abrasive particles/make coat construction via two-roll coater. The size coating weight in each case was about 306 g/m$^2$. The resulting coated abrasives received a thermal cure of 30 minutes at 88° C. followed by 12 hours at 100° C.

After this thermal cure, the coated abrasives were single flexed (i.e., passed over a roller at an angle of 90° to allow a controlled cracking of the make and size coatings), then converted into 7.6 cm by 335 cm coated abrasive belts.

Application of the grinding aid precursor composition as a supersize coating in each case was then performed by using a paint brush, it being appreciated that other methods could be used, such as roll coating or spray coating. The resulting grinding aid precursor-coated abrasive was then subject to a thermal cure of 90 minutes at 115° C.

Examples 1 through 14 and Comparative Examples A and B

The coated abrasives for Examples 1–14 and Comparative Example A were made according to the General Procedure for Making Coated Abrasives. These examples compare the abrading characteristics of coated abrasive articles of this invention with coated abrasive articles outside of the invention. Namely, Comparative Examples A and B do not contain a thermoplastic resin and Examples 6, 9, and 12 do not contain a thermoset resin. Examples 1 to 5, 7 to 8, 10 to 11, and 13 to 14 contain both a thermoset resin and a thermoplastic resin and represent the present invention. The coated abrasive articles were supersized with formulations having binders wherein the concentration of epoxy resin was varied from 100 to 0% while the concentration of three separate thermoplastics was varied from 0 to 100%. The formulations for each supersize composition coated from an organic solvent are listed in Table 1. The Test Procedure was utilized to test these examples. The performance results and supersize coating weights are tabulated in Table 2.

Comparative Example B coated abrasive was a grade 36 Regalloy Polycut Cloth commercially available from the Minnesota Mining and Manufacturing Company, St. Paul, Minn.

TABLE 1

| | Comparative Example | | | | | | | | | | | | | | | |
|---|---|---|---|---|---|---|---|---|---|---|---|---|---|---|---|---|
| Ingredient | A | B | 1 | 2 | 3 | 4 | 5 | 6 | 7 | 8 | 9 | 10 | 11 | 12 | 13 | 14 |
| BPAS | 10.3 | 10.3 | 9.0 | 8.0 | 7.0 | 6.0 | 5.0 | — | 2.4 | 2.0 | — | 2.4 | 2.0 | — | 2.4 | 2.0 |
| PA | 6.8 | 6.8 | 6.0 | 5.3 | 4.7 | 4.0 | 3.3 | — | 1.69 | 1.3 | — | 1.6 | 1.3 | — | 1.6 | 1.3 |
| $KBF_4$ | 51.3 | 51.3 | 53.5 | 53.5 | 53.5 | 53.5 | 53.5 | 62.1 | 62.1 | 62.1 | 62.1 | 62.1 | 62.1 | 62.1 | 62.1 | 62.1 |
| WC100 | 28.0 | 28.0 | 27.3 | 27.3 | 27.3 | 27.3 | 27.3 | 28.1 | 28.1 | 28.1 | 28.1 | 28.1 | 28.1 | 2/.1 | 28.1 | 28.1 |
| TTS | — | — | 0.5 | 0.5 | 0.5 | 0.5 | 0.5 | 0.7 | 0.7 | 0.7 | 0.7 | 0.7 | 0.7 | 0.7 | 0.7 | 0.7 |
| Iron Oxide | 2.2 | 2.2 | 2.1 | 2.1 | 2.1 | 2.1 | 2.1 | 2.6 | 2.6 | 2.6 | 2.6 | 2.6 | 2.6 | 2.6 | 2.6 | 2.6 |
| PA 75 | — | — | 1.6 | 3.3 | 4.9 | 6.6 | 8.3 | 6.5 | 2.5 | 3.2 | — | — | — | — | — | — |
| P6100 | — | — | — | — | — | — | — | — | — | — | 6.5 | 2.5 | 3.2 | — | — | — |
| P5140 | — | — | — | — | — | — | — | — | — | — | — | — | — | 6.5 | 2.5 | 3.2 |
| CAB M5 | 1.4 | 1.4 | — | — | — | — | — | — | — | — | — | — | — | — | — | — |

TABLE 2

| Example No. | Thermoplastic in Supersize Binder | $KBF_4$ Content (%) | Supersize Coating Weight ($g/m^2$) | Performance % of Comparative Example A |
|---|---|---|---|---|
| Comparative A Example | —(0) | 76 | 188 | 100 |
| Comparative B Example | —(0) | 76 | — | 88 |
| 1 | PA75 (10) | 76 | 180 | 92 |
| 2 | PA75 (20) | 76 | 180 | 98 |
| 3 | PA75 (30) | 76 | 172 | 90 |
| 4 | PA75 (40) | 76 | 193 | 104 |
| 5 | PA75 (50) | 76 | 213 | 109 |
| 6 | PA75 (100) | 90 | 163 | 104 |
| 7 | PA75 (40) | 90 | 197 | 115 |
| 8 | PA75 (50) | 90 | 193 | 125 |
| 9 | P6100 (100) | 90 | 163 | 68 |
| 10 | P6100 (40) | 90 | 188 | 116 |
| 11 | P6100 (50) | 90 | 184 | 123 |
| 12 | P5140 (100) | 90 | 172 | 55 |
| 13 | P5140 (40) | 90 | 176 | 121 |
| 14 | P5140 (50) | 90 | 180 | 118 |

Examples 15 through 25 and Comparative Example C

The coated abrasives for Examples 15–25 and Comparative Example C were made according to the General Procedure for Making Coated Abrasives except for the following changes. The backing was a J weight rayon jeans pretreated as described followed by 59 $g/m^2$ (dry) make coating, 264 $g/m^2$ grade 120 mineral (average particle size of 116 micrometers) and 71 $g/m^2$ (dry) size coating. These examples compare the abrading characteristics of coated abrasive articles of this invention. The coated abrasive articles were supersized with formulations having binders wherein the concentration of both epoxy resin and three separate thermoplastics were varied. The formulations for each supersize composition coated from an organic solvent are listed in Table 3. The Test Procedure was utilized to test these examples with the exception that the load was 4.5 kg. The performance results and supersize coating weights are tabulated in Table 4.

TABLE 3

| Ingredient | Comparative C Example | 15 | 16 | 17 | 18 | 19 | 20 | 21 | 22 | 23 | 24 | 25 |
|---|---|---|---|---|---|---|---|---|---|---|---|---|
| BPAS | 11.2 | 2.8 | 6.0 | 2.4 | 5.0 | 2.0 | 2.9 | 2.4 | 2.0 | 2.8 | 2.4 | 2.0 |
| PA | 7.5 | 1.8 | 4.0 | 1.6 | 3.3 | 1.3 | 1.9 | 1.6 | 1.3 | 1.8 | 1.6 | 1.3 |
| $KBF_4$ | 50.4 | 62.2 | 53.4 | 52.2 | 53.4 | 62.2 | 62.2 | 62.2 | 62.2 | 62.2 | 62.2 | 62.2 |
| WC100 | 28.0 | 28.0 | 27.3 | 29.0 | 27.3 | 28.0 | 28.0 | 28.0 | 28.0 | 28.0 | 28.0 | 28.0 |
| TTS | — | 0.7 | 0.5 | 0.7 | 0.5 | 0.7 | 0.7 | 0.7 | 0.7 | 0.7 | 0.7 | 0.7 |
| Iron Oxide | 2.9 | 2.6 | 2.1 | 2.6 | 2.1 | 2.6 | 2.6 | 2.6 | 2.6 | 2.6 | 2.6 | 2.6 |
| PA75 | — | 1.9 | 6.7 | 2.5 | 8.4 | 3.2 | — | — | — | — | — | — |
| P6100 | — | — | — | — | — | — | 1.9 | 2.5 | 3.2 | — | — | — |
| P5140 | — | — | — | — | — | — | — | — | — | 1.9 | 2.5 | 3.2 |

TABLE 4

| Example No. | Thermoplastic in Supersize Binder (%) | $KBF_4$ Content (%) | Supersize Coating Weight ($g/m^2$) | Performance % of Comparative Example C |
|---|---|---|---|---|
| Comparative C Example | —(0) | 74 | 100 | 100 |
| 15 | PA75 (30) | 90 | 113 | 118 |
| 16 | PA75 (40) | 74 | 105 | 96 |
| 17 | PA75 (40) | 90 | 113 | 115 |
| 18 | PA75 (50) | 74 | 109 | 106 |
| 19 | PA75 (50) | 90 | 113 | 123 |
| 20 | P6100 (30) | 90 | 109 | 116 |
| 21 | P6100 (40) | 90 | 109 | 126 |
| 22 | P6100 (50) | 90 | 109 | 119 |
| 23 | P6100 (30) | 90 | 109 | 116 |
| 24 | P5140 (40) | 90 | 109 | 122 |
| 25 | P5140 (50) | 90 | 113 | 129 |

Examples 26 through 35 and Comparative Example D

The coated abrasives for Examples 26–35 and Comparative Example D were made according to the General Procedure for Making Coated Abrasives except for the following changes. The backing was a J weight rayon jeans pretreated as described followed by 59 $g/m^2$ (dry) make coating, 264 $g/m^2$ grade 120 mineral (average particle size of 116 micrometers) and 71 $g/m^2$ (dry) size coating. These examples compare the abrading characteristics of coated abrasive articles of this invention. The coated abrasive articles were supersized with formulations having binders wherein the concentration of both epoxy resin and three separate thermoplastics were varied. The formulations for each supersize composition coated from an aqueous system are listed in Table 5. The Test Procedure was utilized to test these examples with the exception that the load was 4.5 kg. The performance results and supersize coating weights are tabulated in Table 6.

TABLE 5

| Ingredient | Comparative D Example | 26 | 27 | 28 | 29 | 30 | 31 | 32 | 33 | 34 | 35 |
|---|---|---|---|---|---|---|---|---|---|---|---|
| BPAW | 29.2 | 20.5 | 8.5 | 7.3 | 6.1 | 8.5 | 7.3 | 6.1 | 8.5 | 7.3 | 6.1 |
| EMI | 0.35 | 0.35 | 0.35 | 0.35 | 0.35 | 0.35 | 0.35 | 0.35 | 0.35 | 0.35 | 0.35 |
| $KBF_4$ | 53.3 | 53.3 | 62.9 | 62.9 | 62.9 | 62.9 | 62.9 | 62.9 | 62.9 | 62.9 | 62.9 |
| Water | 14.1 | 13.3 | 20.6 | 20.4 | 20.3 | 20.6 | 20.4 | 20.3 | 20.6 | 20.4 | 20.3 |
| AOT | 0.75 | 0.75 | 0.75 | 0.75 | 0.75 | 0.75 | 0.75 | 0.75 | 0.75 | 0.75 | 0.75 |
| Iron Oxide | 2.3 | 2.3 | 2.9 | 2.9 | 2.9 | 2.9 | 2.9 | 2.9 | 2.9 | 2.9 | 2.9 |
| T1085 | — | — | — | — | — | — | — | — | 4.0 | 5.4 | 6.7 |
| PT95 | — | — | — | — | — | 4.0 | 5.4 | 6.7 | — | — | — |
| PTLC | — | 9.5 | 4.0 | 5.4 | 6.7 | — | — | — | — | — | — |

TABLE 6

| Example No. | Thermoplastic in Supersize Binder (%) | $KBF_4$ Content (%) | Supersize Coating Weight ($g/m^2$) | Performance % of Comparative Example D |
|---|---|---|---|---|
| Comparative D Example | —(0) | 75 | 126 | 100 |
| 26 | PTLC (30) | 75 | 109 | 162 |
| 27 | PTLC (30) | 90 | 121 | 203 |
| 28 | PTLC (40) | 90 | 121 | 201 |

TABLE 6-continued

| Example No. | Thermoplastic in Supersize Binder (%) | $KBF_4$ Content (%) | Supersize Coating Weight ($g/m^2$) | Performance % of Comparative Example D |
|---|---|---|---|---|
| 29 | PTLC (50) | 90 | 121 | 218 |
| 30 | PT95 (30) | 90 | 117 | 217 |
| 31 | PT95 (40) | 90 | 117 | 208 |
| 32 | PT95 (50) | 90 | 113 | 239 |
| 33 | T1085 (30) | 90 | 117 | 233 |
| 34 | T1085 (40) | 90 | 126 | 210 |
| 35 | T1085 (50) | 90 | 126 | 227 |

Examples 36 through 40 and Comparative Examples E and F

The coated abrasives for Examples 36–40 and Comparative Examples E and F were made according to the General Procedure for Making Coated Abrasives. Comparative Example F is supersized with the formulation of Comparative Example A (see Table 1). These examples compare the abrading characteristics of coated abrasive articles of this invention. The coated abrasive articles were either sized or supersized with formulations having binders wherein the concentration of both epoxy resin and Piccotex LC-55WK (PTLC) thermoplastic were varied. The formulations for each size or supersize composition coated from an aqueous system are listed in Table 7. The Test Procedure was utilized to test these examples with the exception that the load was 9.1 kg. The performance results for supersized articles and their coating weights are tabulated in Table 8. Table 9 tabulates the performance results for sized articles and their coating weight compared with supersized Comparative Example E.

TABLE 7

| Ingredient | Comparative Example E | 36 | 37 | 38 | 39 | 40 |
|---|---|---|---|---|---|---|
| BPAW | 29.0 | 9.0 | 7.7 | 6.4 | 6.5 | 6.4 |
| EMI | 0.35 | 0.35 | 0.35 | 0.35 | 0.35 | 0.35 |
| $KBF_4$ | 52.7 | 66.2 | 66.2 | 66.2 | 67.0 | 66.2 |
| Water | 14.9 | 15.3 | 15.1 | 15.0 | 15.2 | 15.0 |
| AOT | 0.75 | 0.75 | 0.75 | 0.75 | 0.75 | 0.75 |

TABLE 7-continued

| Ingredient | Comparative Example E | 36 | 37 | 38 | 39 | 40 |
|---|---|---|---|---|---|---|
| Iron Oxide | 2.3 | 3.1 | 3.1 | 3.1 | 3.1 | 3.1 |
| CAB M5 | — | 1.1 | 1.1 | 1.1 | — | 1.1 |
| PTLC | — | 4.2 | 5.7 | 7.1 | 7.1 | 7.1 |

TABLE 8

| Example No. | Thermoplastic in Supersize Binder (%) | $KBF_4$ Content (%) | Supersize Coating Weight ($g/m^2$) | Performance % of Comparative Example E |
|---|---|---|---|---|
| Comparative Example E | —(0) | 76 | 197 | 100 |
| Comparative Example F | —(0) | 76 | 188 | 113 |
| 36 | PTLC (30) | 90 | 272 | 151 |
| 37 | PTLC (40) | 90 | 280 | 152 |
| 38 | PTLC (50) | 90 | 272 | 150 |

TABLE 9

| Example No. | Thermoplastic in Size Resin (%) | $KBF_4$ Content (%) | Size/ Supersize Coating Weight ($g/m^2$) | Performance % of Comparative Example E |
|---|---|---|---|---|
| Comparative Example E | —(0) | 76 | 306/197 | 100 |
| 39 | PTLC (50) | 90 | 486/0 | 105 |
| 40 | PTLC (50) | 90 | 406/0 | 124 |

Examples 41 through 46 and Comparative Examples G and H

The coated abrasives for Examples 41–46 and Comparative Examples G and H were made according to the General Procedure for Making Coated Abrasives except for the following changes. Onto the described pretreated backing was applied 197 $g/m^2$ make coating, 559 $g/m^2$ grade 50 mineral (average particle size 375 micrometers) and 188 $g/m^2$ size coating (except Examples 41–45, see Table 11). These examples compare the abrading characteristics of coated abrasive articles of this invention. The coated abrasive articles were either sized or supersized with formulations having binders wherein the concentration of both epoxy resin and Piccotex LC-55WK (PTLC) thermoplastic were varied. The formulations for each size or supersize composition coated from an aqueous system are listed in Table 10. Test Procedure I was utilized to test these examples with the exception that the load was 6.8 kg. The performance results for sized articles and their coating weights are tabulated in Table 11 and compared with supersized Comparative Example G. Table 12 tabulates the performance results for supersized articles and their coating weights.

The formulations for Examples 45 and 46 are identical to the formulation for Example 40 (see Table 7). Example 43's formulation is identical to the formulation for Example 36 (see Table 7). The formulation for Example 44 is identical to the formulation for Example 37 (see Table 7).

TABLE 10

| Ingredient | Comparative Example G/H | 41 | 42 |
|---|---|---|---|
| BPAW | 29.0 | 17.3 | — |
| EMI | 0.35 | 0.35 | — |
| $KBF_4$ | 52.7 | 52.5 | 53.7 |
| Water | 14.9 | 12.8 | 16.9 |
| AOT | 0.75 | 0.75 | — |
| Iron Oxide | 2.3 | 2.3 | 2.4 |
| CAB M5 | — | 1.5 | — |
| PTLC | — | 12.5 | 12.9 |
| RPR | — | — | 14.1 |

TABLE 11

| Example No. | Thermoplastic in Size Resin (%) | $KBF_4$ Content (%) | Size/ Supersize Coating Weight ($g/m^2$) | Performance % of Comparative Example G |
|---|---|---|---|---|
| Comparative Example G | —(0) | 76 | 188/130 | 100 |
| 41 | PTLC (40) | 75 | 326/0 | 168 |
| 42 | PTLC (40) | 75 | 326/0 | 168 |
| 43 | PTLC (30) | 90 | 377/0 | 271 |
| 44 | PTLC (40) | 90 | 368/0 | 279 |
| 45 | PTLC (50) | 90 | 394/0 | 279 |

TABLE 12

| Example No. | Thermoplastic in Supersize Binder (%) | $KBF_4$ Content (%) | Supersize Coating Weight ($g/m^2$) | Performance % of Comparative Example H |
|---|---|---|---|---|
| Comparative Example H | —(0) | 76 | 130 | 100 |
| 46 | PTLC (50) | 90 | 188 | 234 |

Viscosities of Aqueous Epoxy/Thermoplastic (BPAW/PTLC) Blends

Viscosities varying the weight ratio of BPAW to PTLC are tabulated in Table 13. A standard formulation containing 74% KBF4 at 74% non-volatile solids was compared with 90% KBF4 at 80% non-volatile solids. These two formulations were subsequently modified with up to 50% PTLC. Viscosities were recorded on a Brookfield ¼ RVT viscometer at 21° C., using a number 6 spindle at 50 rpm.

TABLE 13

| BPAW/PTLC Ratio | Example Formulation Number* | Viscosity (Cps) F74-74% Solids | Viscosity (Cps) F90-80% Solids |
|---|---|---|---|
| 100/0 | Comparative Example E | 750 | 8750 |
| 90/10 | — | 625 | 2150 |
| 80/20 | — | 550 | 950 |
| 70/30 | 36 | 475 | 815 |
| 60/40 | 37 | 475 | 715 |
| 50/50 | 38 | 650 | 663 |

TABLE 13-continued

| BPAW/PTLC Ratio | Example Formulation Number* | Viscosity (Cps) F74-74% Solids | Viscosity (Cps) F90-80% Solids |
|---|---|---|---|

*Each formulation does not contain CAB M5.

Various modifications and alterations of this invention will become apparent to those skilled in the art without departing from the scope of this invention, and it should be understood that this invention is not to be unduly limited to the illustrated embodiments set forth herein.

What is claimed is:

1. A method of making a coated abrasive article adapted to contact and abrade a workpiece, the method comprising:

(a) providing a backing;

(b) providing an abrasive surface comprising abrasive particles and a binder, said binder adhering said abrasive particles to said backing;

(c) applying to at least a portion of said abrasive surface a grinding aid precursor composition which comprises (1) a thermoset resin having a thermoplastic resin dispersed therein, said thermoplastic resin and said thermoset resin are present at a weight ratio sufficient to improve at least one of rheological and grinding efficiency effects of the grinding aid composition; and (2) a plurality of grinding aid particles dispersed in said thermoset resin; said grinding aid particles are present in said grinding aid composition in an amount effective to increase grinding efficiency; and (d) subjecting the grinding aid precursor composition to conditions sufficient to substantially cure said thermoset resin.

2. A method in accordance with claim 1 wherein said weight ratio is at least 0.1:1.0.

3. A method in accordance with claim 1 wherein said weight ratio is at least 0.3:1.0.

4. A method in accordance with claim 1 wherein said thermoplastic resin comprises low softening point nonpolar materials selected from the group consisting of:

(a) aliphatic hydrocarbons; and (b) polymerized units of $C_7$ to $C_9$ inclusive aromatic monomers.

5. A method in accordance with claim 1 wherein said thermoset resin comprises an epoxy resin and a curing agent.

6. A method in accordance with claim 5 wherein said epoxy resin is emulsified.

7. A method in accordance with claim 1 wherein said thermoplastic resin is emulsified.

8. A method in accordance with claim 1 wherein said grinding aid is selected from the group consisting of halide salts, halogenated polymers, and sulfur-containing compounds.

9. A method in accordance with claim 8 wherein said halide salt is selected from the group consisting of $KBF_4$, cryolite, and ammonium cryolite.

10. A method in accordance with claim 1 wherein said plurality of grinding aid particles are present in said grinding aid composition in an amount of at least 85 weight percent based on weight of said composition.

11. A method in accordance with claim 4 wherein the materials are selected from the group consisting of anionic emulsified thermoplastic resins of (a) and (b).

12. A method in accordance with claim 1 wherein the abrasive surface comprises a make coat.

13. A method in accordance with claim 1 wherein the abrasive surface comprises a make coat and a size coat.

14. A method in accordance with claim 1 wherein the abrasive surface comprises a cured abrasive slurry, said abrasive slurry comprising a binder precursor and said abrasive particles.

15. A method of abrading a workpiece with a coated abrasive article, said method comprising contacting said workplace with said peripheral surface with sufficient force to abrade the workplace while said peripheral surface and said workplace are moving in relation to each other, said coated abrasive article comprising a backing, an abrasive surface comprising a plurality of abrasive particles and a binder adhering said abrasive particles to the backing, and a peripheral coating over the abrasive surface, said peripheral coating comprising a grinding aid composition comprising;

(a) a cured binder comprising a thermoset resin having a thermoplastic resin dispersed therein, said thermoplastic resin and said thermoset resin present at a weight ratio sufficient to improve at least one of rheological and grinding efficiency effects of the grinding aid composition; and (b) a plurality of grinding aid particles dispersed in said cured binder, said grinding aid particles present in said grinding aid composition in an amount effective to increase grinding efficiency.

16. Method in accordance with claim 15 wherein said workpiece is metal.

17. Method in accordance with claim 16 wherein said metal is selected from the group consisting of stainless steel and titanium, and said abrasive article is a coated abrasive.

* * * * *

UNITED STATES PATENT AND TRADEMARK OFFICE

CERTIFICATE OF CORRECTION

PATENT NO.: 5,520,711

DATED: May 28, 1996

INVENTOR(S): Harvey J. Helmin

It is certified that error appears in the above-identified patent and that said Letters Patent is hereby corrected as shown below:

| | |
|---|---|
| Col. 16, line 19 | "KBF4" should read --$KBF_4$-- |
| Col. 18, Table 1, Example 12 | "2/.1" should read --28.1-- |
| Col. 19, Table 2, | "Thermoplastic in Supersize Binder" should read --Thermoplastic in Supersize Binder (%)-- |
| Col. 19, Table 2, Example No. | "Comparative A Example" should read --Comparative Example A--<br>"Comparative B Example" should read --Comparative Example B-- |
| Col. 19, Table 3 | "Comparative C Example" should read --Comparative Example C-- |
| Col. 19, Table 3 Example 17 | "29.0" should read --28.0-- |
| Col. 19, Table 3 Example 20, first row | "2.9" should read --2.8-- |
| Col. 19, Table 3 Example 20, second row | "1.9" should read --1.8-- |
| Col. 21, Table 4 Example No. | "Comparative C Example" should read --Comparative Example C-- |
| Col. 21, Table 5 | "Comparative D Example" should read --Comparative Example D-- |
| Col. 22, Table 6 Example No. | "Comparative D Example" should read --Comparative Example D-- |
| Col. 25, line 50 | "KBF4" should read --$KBF_4$-- |

UNITED STATES PATENT AND TRADEMARK OFFICE

CERTIFICATE OF CORRECTION

PATENT NO.: 5,520,711

DATED: May 28, 1996

INVENTOR(S): Harvey J. Helmin

It is certified that error appears in the above-identified patent and that said Letters Patent is hereby corrected as shown below:

| | |
|---|---|
| Col. 25, line 51 | "KBF4" should read --$KBF_4$-- |
| Col. 28, line 7 | "workplace" should read --workpiece-- |
| Col. 28, line 8 | "workplace" should read --workpiece-- |
| Col. 28, line 9 | "workplace" should read --workpiece-- |

Signed and Sealed this

First Day of December, 1998

*Attest:*

*Attesting Officer*

BRUCE LEHMAN

*Commissioner of Patents and Trademarks*